United States Patent [19]

Kenaio

[11] 4,019,480

[45] Apr. 26, 1977

[54] PNEUMATICALLY OPERATED SPEAR GUN

[76] Inventor: Abdulwahab Kenaio, Rte. 1, Box 385, Elkton, Fla. 32233

[22] Filed: Dec. 29, 1975

[21] Appl. No.: 644,829

[52] U.S. Cl. ..... 124/61; 124/40; 124/31

[51] Int. Cl.[2] ..... F41B 11/00

[58] Field of Search ..... 124/61, 63, 56, 31, 124/58, 70, 73, 57, 71, 41 R; 273/95 A, 106 R

[56] References Cited

UNITED STATES PATENTS

| | | | |
|---|---|---|---|
| 2,923,285 | 2/1960 | Salles | 124/71 X |
| 2,923,286 | 2/1960 | Draganti | 124/70 X |
| 3,045,659 | 7/1962 | Malcolm | 124/57 |
| 3,102,525 | 9/1963 | Englis | 124/57 |
| 3,109,419 | 11/1963 | Hayward | 124/63 |

*Primary Examiner*—Richard C. Pinkham
*Assistant Examiner*—William R. Browne
*Attorney, Agent, or Firm*—Gustave Miller

[57] ABSTRACT

This device is a spear gun for underwater fishing and is operated by a reservoir of compressed air. A reservoir is maintained in an elongate gun barrel within which a slidable piston is located between the pneumatic valve end the other or spear discharge end. A shock absorbing cushion is provided at the discharge end of the gun barrel for stopping the travel of the piston without damage. A gun stock is secured over the gun barrel adjacent the discharge end, and remote from the valve end. The spear rod is provided with a conically reduced portion leading to an abrupt radial shoulder against which shoulder a V-shaped lock is pivoted in the bottom of the spear gun to abutting position to hold the spear in position ready for firing. An L-shaped sear is pivoted to a trigger rod slidably reciprocable through bearings for releasably engaging the V-shaped lock. The end of the trigger rod is provided with a trigger extending into the gun stock to adjacent an eccentric cam having a lever handle, for rotating it between trigger locking or safety position and a trigger release or firing position. The forward end of the spear has a lanyard receiving loop secured therethrough, and the extreme forward end of the spear is threaded for removably receiving the hook or harpoon which may be interchanged depending on the type of fish that is being fished for.

10 Claims, 7 Drawing Figures

PNEUMATICALLY OPERATED SPEAR GUN

OBJECTS OF THIS INVENTION

It is an object of this invention to provide a spear gun that is of light weight and has better handling characteristics for the gun carrier.

A further object of this invention is to provide a spear gun that is operated by air pressure provided therein through a pneumatic valve to a desired amount, and where the pressure is retained indefinitely substantially unimpaired for succeeding operations rather than having to have new pressure provided for each operation of the spear gun.

Yet a further object of this invention is to provide a better operation, better handling and long life.

Still a further object of this invention is to provide a unique spear gun that is reliable and well balanced for easy and convenient carrying and operation.

Another object of this invention is to provide a spear gun that is extremely economical to operate, in that the power is provided by compressed air through a conventional pneumatic valve from any suitable source, such as a tire pump.

Still a further object of this invention is to provide a reciprocable piston in the gun barrel for transmitting the pressure to the spear, and a piston shock absorber to slow up and stop the travel of the piston at the discharge end of the gun barrel.

A still further object of this invention is to provide a spear gun having a simple operation which is easy to maintain.

Yet another object of this invention is to provide a spear gun wherein the operating pressure may be set to provide a shooting range, as desired, the higher the pressure the greater the blow of the spear and the longer the possible range.

Yet a further object of this invention is to provide a spear gun that has an easily operated safety latch preventing operation of the spear gun until the safety latch is set to the firing position.

A still further object of this invention is to provide a spear gun having a minimum number of movable parts and thus have more reliability and easier maintenance.

A further object of this invention is to provide a spear gun that is an improvement over U.S. Pat. Nos. 2,833,266; 3,045,659; 3,109,419; 3,354,572; 3,735,747; 3,780,720; and all the other prior art.

BRIEF DESCRIPTION OF THE FIGURES

With the above and other objects in view, this invention consists in the details of construction and combination of parts, as will be more fully understood from the following description, when read in conjunction with the accompanying drawings, in which.

DETAILED DESCRIPTION OF THIS INVENTION

Figure 7:
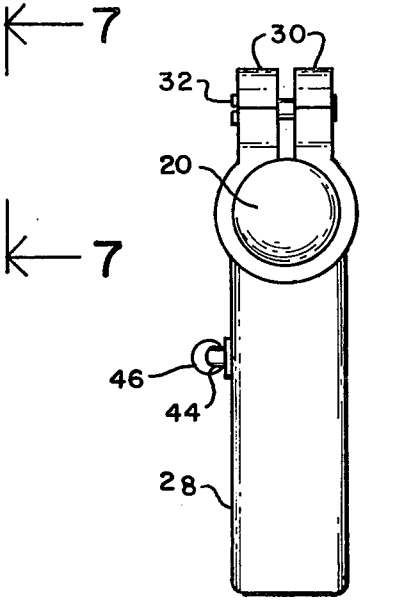
FIG. 7 is a rear end view of the spear gun, on line 7—7 of FIG. 1.
Figure 1:
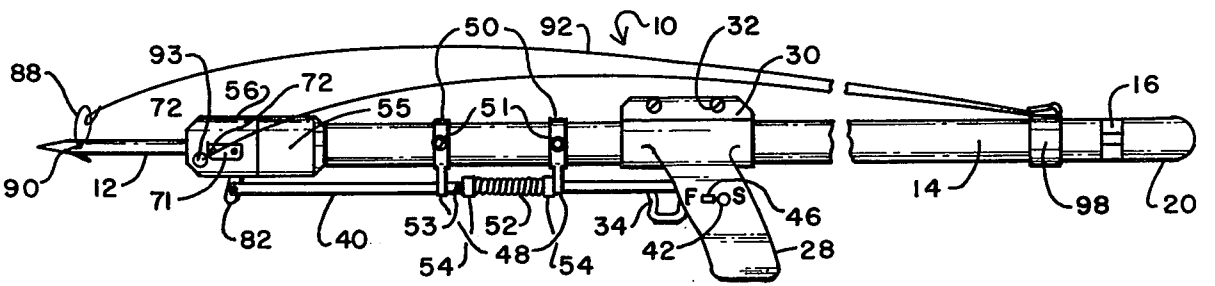
FIG. 1 is a side elevation of the loaded spear gun of this invention, the gun barrel being partly broken away.
Figure 2:
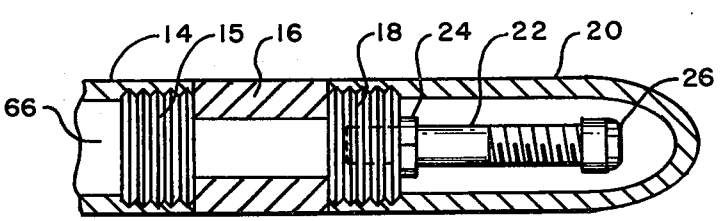
FIG. 2 is a sectional, broken away pressure inserting rear end view of the gun barrel, on a larger scale.

There is shown at 10 the spear gun of this invention, with the rod spear 12 loaded therein ready for firing. The spear gun 10 includes an elongate hollow cylindrical gun barrel 14 at the rear end of which there is threaded therein at 15 a valve receiving plug 16, externally threaded at its other end at 18 for detachably receiving a valve protecting cap 20. At the end of the plug 16 a conventional pneumatic valve 22 is threaded therein. Valve 22 has its body shaped at 24 for receiving a wrench. A valve stem cap 26 is threadedly, detachably secured on the threaded end of valve 22.

Adjacent but spaced from the forward, discharge end of the barrel 14 is a gun stock 28. Drain holes 31 are provided in the bottom of the gun stock 28. The gun stock 28 has semicircular thickened wings 30 fitted about the barrel and clamped thereon by screws 32 extending through one wing and threaded into the other wing, clamping the wings 30 together on the gun barrel 14. A trigger 34 extends below the gun barrel 14, as shown, and on the forward side of the gun stock 28 there is provided a trigger receiving vertical aperture 36 for the back end trigger 38 to reciprocate thereinto. As seen, the trigger 34 is a squared end of the trigger rod 40.

Figure 3:
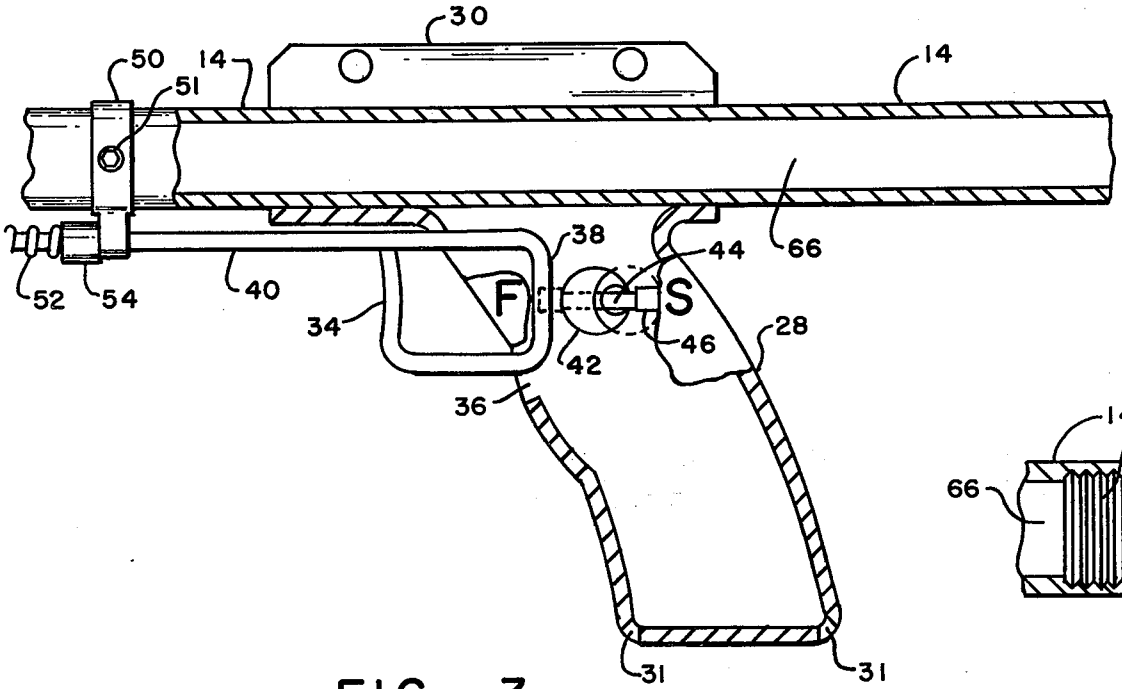
FIG. 3 is a sectional, broken away view of the gun stock portion on a slightly smaller scale than FIG. 2.
Figure 4:
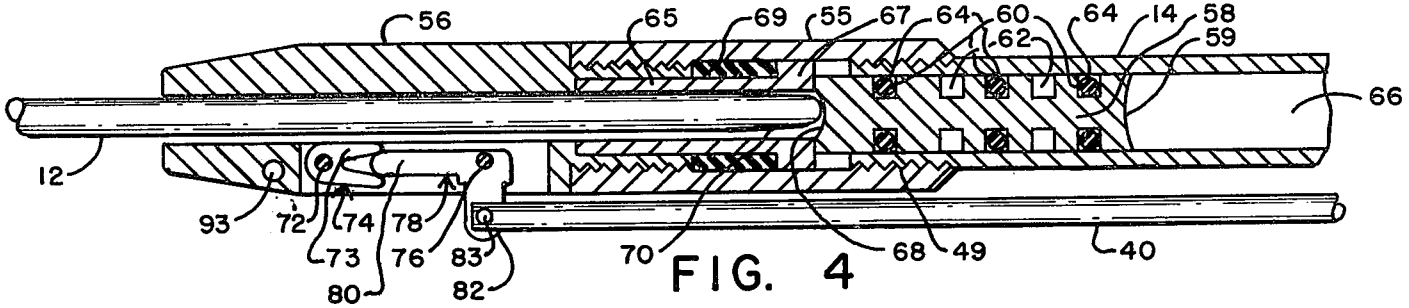
FIG. 4 is a sectional view of the discharge end of the spear gun, with the piston and spear at the moment when pressure cylinder is at the discharge end of its travel and the spear has just finished receiving its complete pressure impulse.

Within the gun stock 18, there is provided an eccentrically pivoted cam 42 mounted on a shaft 44 terminating in a cam shaft handle 46. This cam shaft handle 46 controls the rotation of the cam 42, the shaft handle 46 extending from the cam shaft 44. When the cam shaft handle 46 extends rearwardly, as in FIG. 3, it extends toward a letter S, for Safety Stock, on the gun 28, and the cam 42 extends forwardly into abutting position against the trigger 38, holding the trigger in forward position, locked against operation in SAFE position. When the cam shaft handle 46 is rotated to extend forward to the firing position F, the trigger 38 is released from contact with the cam 42, and the trigger 38 may then be pulled to fire the spear rod 12.

Figure 6:
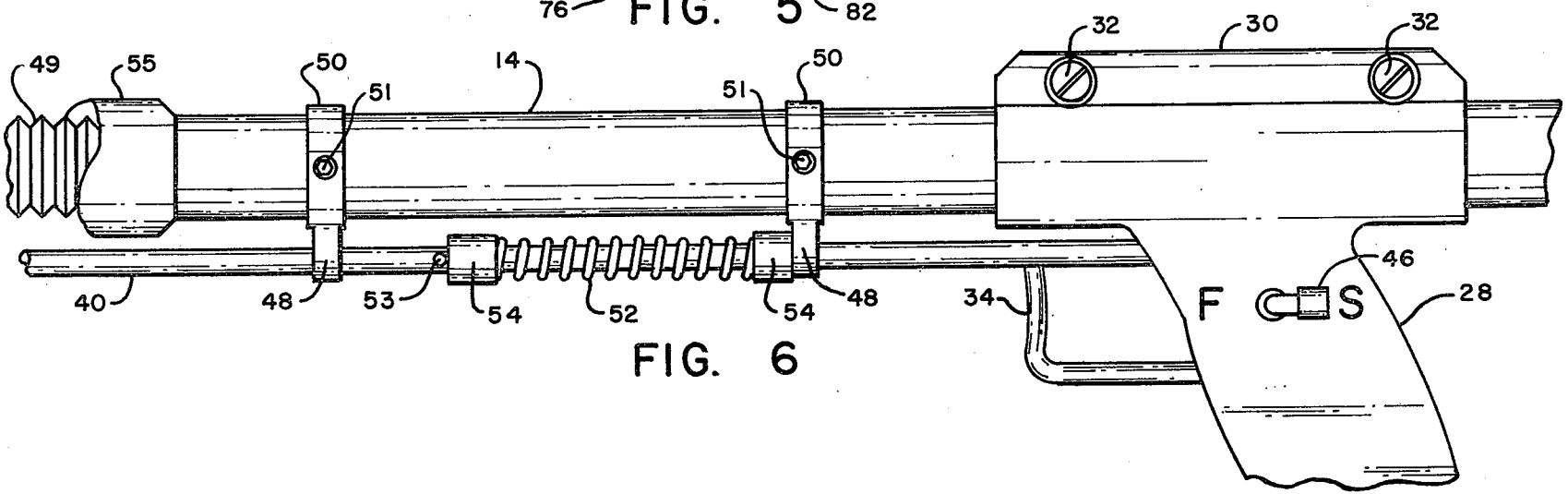
FIG. 6 is an elevation view of a portion of the barrel, including the gun stock, trigger and trigger spring.

The trigger rod 40 is reciprocably journalled through two bearings 48 secured on rings 50 fixed on the gun barrel 14 by screws 51, as shown in FIG. 6. A trigger biasing spring 52 on the trigger rod 40 is located between two abutments 54 slidable between the rearward bearing 48 and a pin 53 through the trigger rod 40. The spring 52 thus biases the trigger rod forwardly.

Threadedly secured at 49 on the forward end of barrel 14 is a bored plug 55. The forward end of plug 55 is internally threaded to receive the threaded rear end of bored head 56. Within the barrel 14 there is slidably reciprocatably stationed piston 58, concaved at its rear end 59, provided with five spaced apart circumferential grooves 60 and 62. The three grooves 60 are O-ring piston grooves in each of which there is an O-ring 64 of suitable material, such as neoprene rubber or other suitable material, which press against the inner surface of the cylindrical elongate tubular gun barrel 14 and prevent leakage of air pressure from the reservoir side 66 of the piston 58, the pressure reservoir 66 extending from the rear fully concave side of piston 58 to the pneumatic valve rear end of the gun barrel 14. The two grooves 62 are oil or lubrication receiving grooves, one each being on opposite sides of center piston ring groove 60, and between such center groove 60 and the end grooves 60. About ten drops of oil in these oil grooves 62 provide sufficient lubrication for from eight hundred to one thousand firings of this spear gun, and along with the O-rings 64 maintain the pressure reservoir 66 against leakage.

This reservoir 66 may be charged with air pressure through the pneumatic valve 22 to a maximum pressure of 200 p. s. i. The variation of the reservoir pressure determines the thrust of the spear as well as the spear shooting range. With a pressure of 55 p. s. i. a distance of 40 feet can be obtained. An average increase of 5 feet in range is provided by each additional 10 p. s. i. when the pressure is over 55 p. s. i. The reliability and ability to operate under high pressure and high or low temperature has been proven in a hard test.

The forward end of pressure maintaining and transmitting cylinder 58 is provided with a recessed seat 68 into which the slightly tapered rear butt end 70 of spear 12 is pushed, facilitating entry when the spear gun 10 is loaded. The bored plug 55 and bored head 56 are provided with axially aligned bores through which the spear rod 12 is snugly, yet loosely, reicprocable to extend into the barrel 14 against recessed seat 68 in the piston 58.

Slidably reciprocable within the threaded portion of bored head 56 is a metal cylinder 65 having a flange 67 slidable within the bored head 55, and surrounding the cylinder 65 between its flange 67 and the threaded end of bored head 56 is a shock absorbing rubber sleeve 69. When the piston 58 hits the flange 67, the rubber sleeve 69 compresses to absorb the shock as it stops it without damage.

On the bottom of but within recessed sides 71 of the bored head 56 there is pivoted at 72 a V-shaped spear lock 74. Also pivoted at 76 is an L-shaped sear or catch 78, one L-leg 80 extending into the mouth of the V of the V-lock 74 and the other L-leg 82 extending down externally of the head 56 into the bifurcated end of trigger rod 40 to which it is pivoted at 80.

The spear 12, as shown in FIG. 7, is elongate and of a diameter to snugly yet be freely reciprocable through the aligned bores in bored head 56 and bored plug 54 and against the piston seat 68 into the gun barrel 14.

On the spear rod 12 adjacent but sufficiently spaced from its forward or hitting end there is provided rearwardly directed iconically reduced portion 84, terminating in a radially extending shoulder 86. This conically reduced portion 84 permits the upper tine 73 of the V-lock 74 to extend therein and abut the shoulder 86 and lock the spear rod 12 in the spear gun 10 when the spear rod has been manually inserted against the piston 58 and the pressure in the reservoir 66 until the spear rod shoulder 86 is far enough in to have the upper tine 73 of the lock 74 move into locking position against the shoulder 86 under the bias of the trigger spring 52, with the cam 42 rotated to S or SAFE position.

Figure 5:
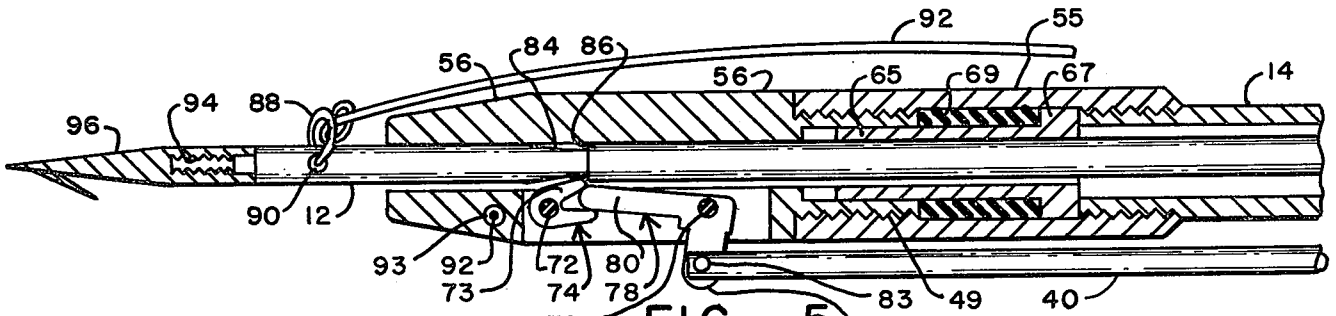
FIG. 5 is a sectional view similar to FIG. 4 showing the spear rod fully inserted and in locked position, ready for the firing operation.

Spaced forwardly from the reduced conical portion 84 of spear 12 there is secured a lanyard receiving loop 88, which may be secured through a diametrical aperture 90 far enough forward so that it remains forward of the bored head 56 when the spear 12 is locked within the gun barrel 14, as shown in FIG. 5.

A lanyard 92 is secured at one end to loop 88, and is of enough length to permit the spear rod to travel the prescribed distance, and the other end of the lanyard is anchored to the spear through a transverse aperture 93 in recessed side 72 of head 56. A conventional rubber lanyard holder 98 is fitted over barrel 14 to yieldably retain the intermediate portion of the lanyard 92.

The forward end of the spear 12 is provided with a threaded neck 94 on which may be threaded any one of several conventional hooks or harpoons 96 suitable to the particular fish or marine animal that is being hunted.

OPERATION OF THE INVENTION

In operation, the reservoir 66 in barrel 14 is filled with the desired air pressure through the valve 22 from any suitable source. The spear rod 12 is fitted with its desired hook or harpoon 96. After placing the trigger 38 in F or FIRE position, the spear rod 12 is manually rammed through the bored head 56 and plug 54 against the piston 58 and reservoir 66 until the upper tine 73 of V-lock 74 snaps to locked position behind the spear radial shoulder 86 under bias of trigger spring 52. The cam 42 is then rotated to S or SAFE position by its cam handle 46, and the spear gun 10 is then ready for use. To use it, the cam is first rotated to F or FIRE position and, subsequently, when trigger 38 is pulled back into the gun stock 38, the V-lock 74 will be rotated away from the spear shoulder 86 permitting the spear to fire under the pressure of the reservoir 66, and the pressure piston is stopped by cylinder 65 and the rubber sleeve 69.

ABSTRACT OF THE DRAWING

In the drawings, like reference numerals refer to like parts, and for the purpose of explication marshalled below are the following numerals of this Spear Gun.

| REFERENCE NUMBERS: | SHOWN IN FIGS.: |
|---|---|
| 10 spear rod | 1 |
| 12 spear rod | 1, 4, 5 |
| 14 gun barrel | 1, 2, 3, 4, 5, 6 |
| 15 valve plug forward thread | 2 |
| 16 valve receiving plug end of 14 | 1, 2 |
| 18 rear threads on 16 | 2 |
| 20 valve protecting cap | 1, 2, 7 |
| 22 pneumatic valve | 2 |
| 24 nut shape on body of 16 for cooperating with a wrench | 2 |
| 26 valve stem cap | 2 |
| 28 gun stock | 1, 3, 6, 7 |
| 30 clamping wings on 28 | 1, 3, 6, 7 |
| 31 drain hole in 28 | 3 |
| 32 wing clamping screws | 1, 6, 7 |
| 34 trigger | 1, 3, 6 |
| 36 trigger receiving aperture in 28 | 3 |
| 38 back end of trigger 34 | 3, 6 |
| 40 trigger rod | 1, 3, 4, 5, 6 |
| 42 eccentrically pivoted trigger locking cam | 1, 3 |
| 44 cam shaft | 3, 7 |
| 48 trigger rod bearings | 1, 6 |
| 49 thread on discharge end of gun barrel 14 | 4, 5 |
| 50 bearing mounting rings | 1, 6, 3 |
| 51 ring securing screws | 1, 6, 3 |
| 52 trigger biasing spring | 1, 6, 3 |
| 53 abutment pin fixed through trigger rod 40 | 1, 6 |
| 54 slidably mounted spring abutments on 40 | 1, 6, 3 |
| 55 bored plug | 1, 4, 5, 6 |
| 56 bored head | 1, 4, 5 |
| 58 piston | 4 |
| 59 concave rear end of 58 | 4 |
| 60 O-ring piston grooves in 58 | 4 |
| 62 oil grooves in 58 | 4 |

-continued

| REFERENCE NUMBERS: | SHOWN IN FIGS.: |
|---|---|
| 64 O-rings | 4 |
| 65 metal flanged cylinder slidable within end of 56 | 4, 5 |
| 66 pressure reservoir in 14 | 2, 3, 4 |
| 67 rear flange on 65 | 4, 5 |
| 68 spear butt end receiving recessed seat in 58 | 4 |
| 69 shock absorbing rubber sleeve | 4, 5 |
| 70 slightly tapered rear butt end of spear rod | 4 |
| 71 recessed sides of head 56 | 1 |
| 72 pivot of lock 74 | 1, 4, 5 |
| 73 upper tine of lock 74 | 4, 5 |
| 74 V-shaped spear lock | 4, 5 |
| 76 pivot of sear 78 | 4, 5 |
| 78 L-shaped sear or catch for lock 74 | 4, 5 |
| 80 upper L-leg of 78 extending into V of lock 74 | 4, 5 |
| 82 depending L-leg of 78 pivoted to 40 | 4, 5 |
| 84 conically reduced portion of 12 | 5 |
| 86 radial shoulder in 12 | 5 |
| 88 loop for lanyard 92 | 1, 5 |
| 90 loop aperture through 12 | 1, 5 |
| 92 lanyard | 1, 5 |
| 93 lanyard anchor aperture through 71 of 56 | 1, 4, 5 |
| 94 threaded neck on 12 for hook or harpoon 96 | 5 |
| 96 hook or harpoon | 5 |
| 98 rubber lanyard retainer | 1 |

Although this invention has been described in considerable detail, such description is intended as being illustrative rather than limiting since the invention may be variously embodied.

Having thus set forth the nature of this invention, what is claimed is:

1. A spear gun (10) for underwater fishing and like purposes comprising a gun barrel (14), a pneumatic valve means (16, 24) secured (24) to the rear end (16) of said barrel (14) permitting a desired air pressure to be provided therethrough into said barrel, a valve protecting cap (20) threaded over said barrel rear end (16), a gun stock (28) secured (30, 32) about said gun barrel (14), a piston (58) fitting snugly yet slidably within said gun barrel, said piston (58) having a plurality of O-ring piston grooves (60) and O-rings (64) therein spaced apart along its cylindrical surface and a lubrication groove (62) intermediate each pair of O-ring piston grooves (62) maintaining the pressure in said barrel (14), said discharge end of said gun barrel (14) being externally threaded (49), a cylindrical bored plug (55) threaded at one end on said externally threaded discharge end (49) of said barrel, a bored head (56) having its rear end threadedly secured to the other end of said plug (55), a spear (13) having a cylindrical rod extendable through said bored plug (56) and through said bored head (55) into contact with the forward end (68) of said piston (58), said spear rod (12) having a conically reduced portion (84) adjacent to but spaced from its spearing end (94) providing a radial shoulder (86) facing toward said spearing end, said spearing end being threaded (94) to receive and secure a harpoon hook (96) thereon, a V-shaped spear lock (74) secured in said bored head (56) adjacent its bore to pivot (72) its upper tine (73) against said conical portion (84) of said spear rod (14) to abut said spear rod radial shoulder (86) when said shoulder is positioned thereagainst, an L-shaped sear (78) pivotally (76) secured in said head (56) with its upper L-leg (80) extending into the mouth of the V of said V-shaped spear lock (74) and with its other L-leg (82) extending externally of and below said head (56), a trigger rod (40) pivoted (83) at one end to said externally extending L-leg (82), the other end of said trigger rod (40) providing a trigger (34) extendable partly (36) into said gun stock (28), an eccentric trigger locking and releasing cam (42) pivoted (44) in said gun stock (28) and a manually operable lever handle (46) secured to said cam (42) extending externally of said gun stock (28) for rotating said cam to abut said trigger (34) and lock it against operation or for rotating it away from said trigger (34) for releasing said trigger for operation, a pair of spaced apart rings (50) secured (51) on said barrel (14) supporting depending bearings (48) about said trigger rod (40) through which said trigger rod may be freely reciprocated, a trigger spring (52) biased against one of said bearings (48) and against an abutment (53) secured to said trigger rod (40) biasing said trigger rod to spear rod locking position (73 and 86) whereby when said gun barrel has been pressurized (66) through said pneumatic valve (22) to the desired pressure, said spear rod (12) may be manually inserted and pressed against said piston (58) to push said piston against the pressure (66) in said gun barrel (14) to move said spear rod (14) into the gun barrel (14) until said trigger spring (52) biases said sear (78) to actuate said spear lock (74) into spear rod locking position abutting against said spear rod radial shoulder (86), and when said trigger (34) is pulled, after said eccentric cam has been rotated to the trigger releasing position, said spear lock (74) will release said spear rod (12) to be ejected from said gun barrel (14) under the pressure (66) in said gun barrel (14), said pressure (66) remaining substantially unimpaired in said barrel for subsequent operations of said spear gun.

2. The spear gun of claim 1, said piston (58) having a spear end receiving seat (68) recessed in its forward end into which the rear butt end of said spear rod (12) is seated, and a pressure contacting concave rear end.

3. The spear gun of claim 2, said spear rod butt end being slightly tapered (70) to extend into said spear end receiving seat (68).

4. The spear gun of claim 1, there being three said piston ring grooves (60), one at the middle of said piston and one adjacent to but spaced from each end of said piston (58).

5. The spear gun of claim 1, and a lanyard (02) receiving loop (88) secured to said spear rod (12) through a transverse aperture (90) therein located forward of said lock shoulder (86) a distance at least slightly greater than the distance from the spear lock (74) to the discharge end (56) of said spear gun (10).

6. The spear gun of claim 5, and a lanyard (92) secured at one end to said lanyard loop (88) and anchored at its other end to a forward portion of said spear gun (10).

7. The spear gun of claim 1, said gun stock (28) being secured about said gun barrel (14) adjacent to but spaced from the front spear discharge end (40) of said gun barrel, said gun stock havng drain holes (31) at its bottom.

8. The spear gun of claim 1, and a piston shock absorbing means at the forward end of said gun barrel (14) comprising a flanged metal cylinder (65) slidably extendable into said threaded rear end of said bored head (56), and externally extending rear flange (67) on said cylinder (65) slidable within said bored plug (55) and in the path of said piston (58), yieldable sleeve means (69) positioned about said cylinder (65) between said flange (67) and said threaded rear end of said bored head (56) yieldably absorbing the blow of said piston (58) against said flanged cylinder when said spear rod (12) is discharged.

9. The spear gun of claim 1, said pneumatic valve means comprising a plug (16) forwardly threaded into the rear end of said gun barrel (14), the rear end of said plug (16) being also threaded, and a pneumatic valve (24) secured through said plug threaded rear end to a bore extending through said plug (16) to a pressure reservoir (66) in said gun barrel (14).

10. The spear gun of claim 9, and a pneumatic valve protecting cap (20) removably threaded on said plug threaded rear end.

* * * * *